US007446283B2

(12) United States Patent
Haberkamm

(10) Patent No.: US 7,446,283 B2
(45) Date of Patent: Nov. 4, 2008

(54) METHOD FOR CONTROLLING A COOKING PROCESS, AND COOKING APPLIANCE

(75) Inventor: Ramona Haberkamm, Traunreut (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 4 days.

(21) Appl. No.: 10/546,789

(22) PCT Filed: Mar. 11, 2004

(86) PCT No.: PCT/EP2004/002546

§ 371 (c)(1),
(2), (4) Date: Aug. 24, 2005

(87) PCT Pub. No.: WO2004/086162

PCT Pub. Date: Oct. 7, 2004

(65) Prior Publication Data

US 2006/0081597 A1 Apr. 20, 2006

(30) Foreign Application Priority Data

Mar. 26, 2003 (DE) ..... 103 13 595

(51) Int. Cl.
*H05B 1/02* (2006.01)
*A21B 1/40* (2006.01)
*F24C 7/08* (2006.01)

(52) U.S. Cl. ..... 219/413; 219/492; 219/494; 99/331; 99/337

(58) Field of Classification Search ..... None
See application file for complete search history.

(56) References Cited

U.S. PATENT DOCUMENTS 2,564,321 A * 8/1951 Brosseau ..... 219/492
4,302,660 A * 11/1981 Swanson et al. ..... 219/413
4,401,884 A 8/1983 Kusunoki
5,786,996 A * 7/1998 Vitkus et al. ..... 219/413
5,889,259 A * 3/1999 Krasznai et al. ..... 219/414
5,945,018 A * 8/1999 Halen ..... 219/492
6,084,216 A 7/2000 Slegt
6,140,619 A * 10/2000 Couch ..... 219/492
6,333,492 B1 * 12/2001 Graves et al. ..... 219/413
2002/0023911 A1 * 2/2002 Bales et al. ..... 219/400

FOREIGN PATENT DOCUMENTS

| | | |
|---|---|---|
| DE | 101 29 885 | 10/2002 |
| EP | 0 691 513 | 1/1996 |
| EP | 1 213 542 | 6/2002 |
| EP | 1 273 852 | 1/2003 |

OTHER PUBLICATIONS

International Search Report PCT/EP2004/002546.

* cited by examiner

*Primary Examiner*—Joseph M Pelham
(74) *Attorney, Agent, or Firm*—Russell W. Warnock; James E. Howard

(57) ABSTRACT

A cooking appliance and a method of controlling the cooking process in the cooking appliance. The cooking appliance includes a heating device, especially for grilling. To improve the browning process of food in the cooking appliance the radiation time of the cooking appliance is increased. The time is increased by a temporary cooling-down phase where the temperature is reduced, that is initiated by opening the cooking appliance door, for example, to turn the food being browned. The cooking appliance then increases the temperature again over a subsequent heating-up phase initiated by closing the cooking appliance door.

9 Claims, 2 Drawing Sheets

METHOD FOR CONTROLLING A COOKING PROCESS, AND COOKING APPLIANCE

The invention relates to a method for controlling a cooking process and to a cooking device of the type explained in the preambles of claims 1 and 6.

Cooking devices in the form of cookers or the like are known in large numbers. The cooking process in these cooking devices is usually controlled by the user selecting manually either a certain cooking temperature or a certain predetermined operating mode (and optionally an operating time) to which a certain cooking temperature is automatically allocated. When this cooking temperature is reached, the cooking temperature is then substantially held constant within a temperature regulating cycle, the heating device being switched on and off when a pre-determined temperature is reached in each case, wherein the temperature usually oscillates within a temperature range.

In shorter operating modes, such as the "grilling" operating mode, however there is the problem that the browning of the food is frequently unsatisfactory. In these shorter operating modes the degree of browning of the food depends on the time during which the food is exposed to direct thermal irradiation by the switched-on heating device. In the pre-heating phase the heating device is switched on continuously so that the food is continuously exposed to thermal radiation and thus browns well. During the regulating cycle however, the heating device is switched off cyclically so that the food is exposed to thermal convection in addition to the browning thermal radiation, as a result of which the food is browned less well. This is particularly noticeable when the food needs to be turned in the course of the cooking process, where the first side is then well-browned but the second side is rather cooked and less well browned.

It is the object of the invention to provide a method and a cooking device which provides a better browning result.

The invention is solved by a method according to claim 1 and a cooking device according to claim 6.

The proposal according to the invention to reduce the temperature over the course of a temporary cooling-down phase during the cooking process has the effect that the heating device then remains switched on for a longer time so that the food is exposed to the browning thermal radiation for a longer time.

Advantageous further developments of the invention can be deduced from the dependent claims.

It is particularly appropriate if the temporary cooling-down phase is initiated by switching off the heating device when the door of the cooking compartment is opened. This measure has an additional safety effect since on the one hand, it protects the user for example from excessive thermal radiation when turning the food and on the other hand prevents the heating device from remaining switched on if the door is unintentionally left open.

Figure 1:
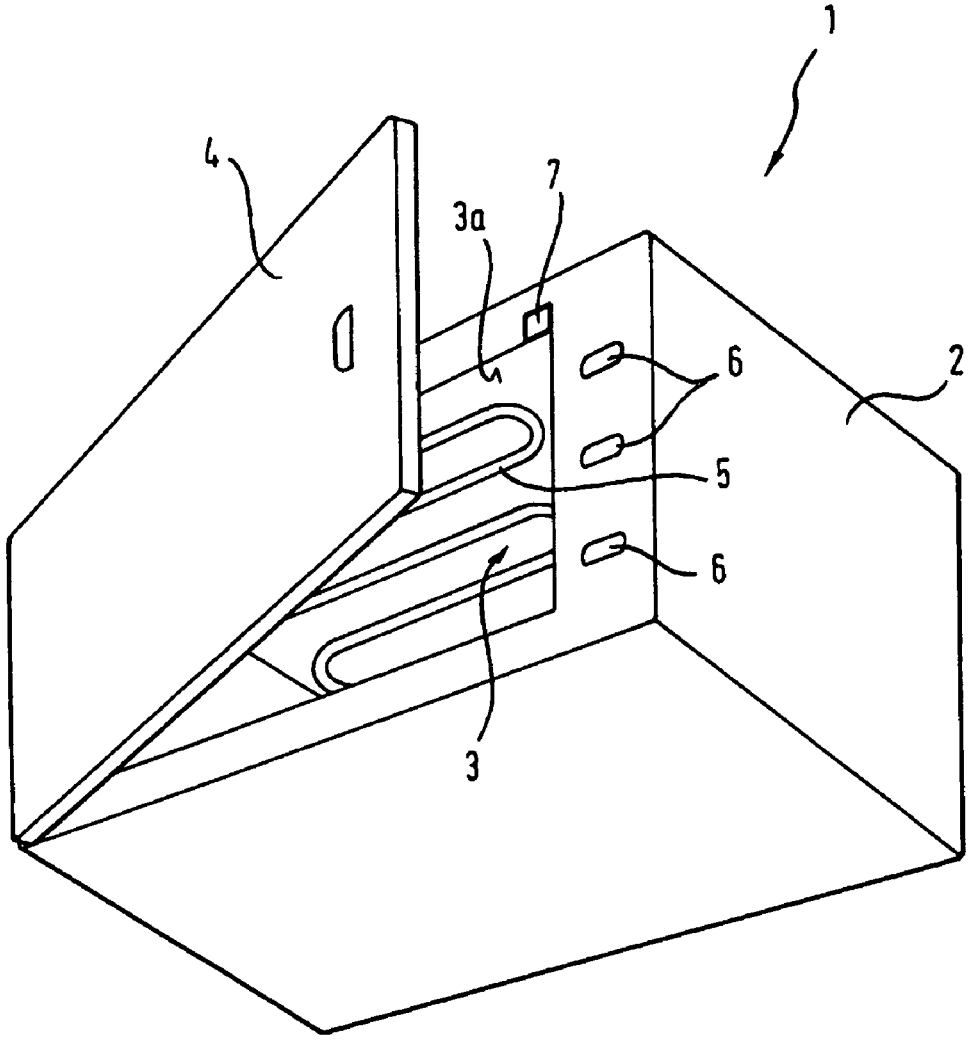
Figure 2:
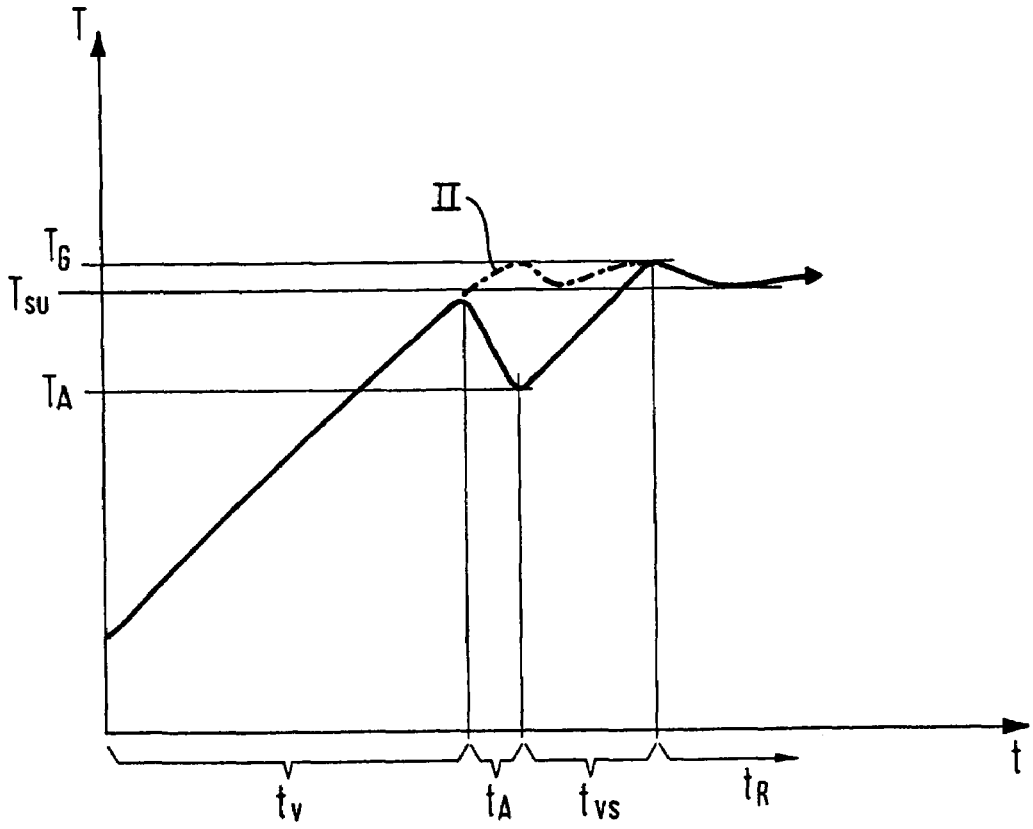

An exemplary embodiment of the invention is explained in detail hereinafter with reference to the drawings. In the figures:

FIG. 1 is a schematic diagram of a cooking device according to the invention and FIG. 2 is a schematic temperature-time curve of an exemplary cooking process.

FIG. 1 shows a cooking device 1 according to the invention which is shown as a grilling device in the present exemplary embodiment. The cooking device contains a housing 2 which surrounds a cooking compartment 3 which is closed by a door 4. Provided in the cooking compartment 3 is a usual heating device 5 in the form of a heating coil which is arranged on the ceiling 3*a* of the cooking compartment 3. Also provided are the usual temperature sensors, preferably in the rear area of the cooking compartment 3 which are not shown in the drawing.

The cooking device 1 further contains a control system not shown which can be actuated by conventional control elements 6.

Connected to the control system is a switching contact 7, which is only shown schematically and which actuates the opening and closing of the door. The switching contact 7 is embodied so that it switches off the heating device 5 as soon as the door 4 is opened and releases the switching on of the heating device 5 as soon as the door 4 is closed.

A cooking process will be explained in detail with reference to the temperature-time curve in FIG. 2. FIG. 2 shows the profile of a grilling process as a preferred cooking process. The user places the food for grilling in the cooking compartment 3 and selects the desired operating mode "grilling" and/or the desired cooking temperature and/or the desired cooking time by means of the control elements 6. After the door 4 is closed, the heating device is switched on and heats the cooking compartment 3 for the time $t_V$. During this time $t_V$, the heating device 5 stays switched on; the side of the food facing the heating device is thus exposed to permanent thermal radiation and consequently browns sufficiently. At the same time, the food pre-cooks. After the time $t_V$ has elapsed, the food must be turned. The user opens the door 4 whereby the heating device 5 is switched off by the switching contact 7. As a result, the cooking compartment 3 is not heated further and the temperature drops to a reduced temperature $T_A$ in the course of a temporary cooling phase $t_A$. If the door 4 is closed again after turning the food, switching on the heating device 5 is released again by means of the switching contact 7 so that the heating to the pre-determined food temperature $T_G$ is continued in the time interval $t_{VS}$ with substantially the same curve gradient as in the range $t_V$. In this way, the beginning of a regulating cycle $t_R$ in which the heating device 5 is switched on and off in a clocked fashion to keep the temperature constant between the cooking temperature $T_G$ and a lower switching temperature $T_{SU}$, is delayed. After turning the food, the second side of the food is thus exposed to the thermal radiation for a longer time than would be the case without the temporary cooling-down phase $t_A$ and the food is browned better on the second side than would be the case with the usual change between the thermal radiation and thermal convection with the usual length of the regulating cycle $t_R$. The cooling-down phase $t_A$ thus brings about a lengthening of the switching-on time of the heating device after the cooling. Without the cooling-down phase $t_A$ on the other hand, the heating-up phase would not be interrupted or would substantially not be interrupted but would continue with the same angle of gradient as far as the cooking temperature $T_G$ and would then go over into the regulating phase as is indicated by the dot-dash profile II in FIG. 2.

It should be pointed out that the heating device 5 is designed as relatively powerful especially for grill devices and the temperature sensors are usually so remote from the door that they cannot be influenced by the user so that opening the door 4 for turning the food with the heating device 5 continuing to run brings about a slight lowering of the temperature but this lowering is not sufficient to significantly increase the switching-on time of the heating device after turning and thus positively influence the degree of browning.

It is important for the efficiency of the invention that the temperature within the temporary cooling-down phase $t_A$ is reduced to a reduced temperature $T_A$ which is lower than the lower switching temperature $T_{SU}$. On the other hand, the temporal arrangement of the temporary cooling-down phase $t_A$ can be applied to any point on the curve, i.e., it can be introduced for example only in the regulating cycle $t_R$ and interrupt this.

The following table shows the effect of lengthening the cooling-down phase on the radiation time during the grilling of a steak.

| | Duration | Grilling steaks without door contact | Grilling steaks with door contact |
|---|---|---|---|
| First side | 10 minutes | Heater on for 10 minutes | Heater on for 10 minutes |
| Turning: | about 30 seconds | Heater is still on | Heater off |
| Second side | 5 minutes | Heater on for 2 minutes Heater off for 3 minutes | Heater on for 3 min 40 sec Heater off for 1 min 10 sec |

In a modification of the exemplary embodiment shown it is further possible to incorporate the temporary cooling-down phase in a cooking program, for example, by stopping the heating device from being switched on again after the temperature has fallen below the lower switching temperature, after first reaching the cooking temperature until the temperature has fallen sufficiently far below the lower switching temperature or has been actively lowered so that an extended radiation time of the heating device is then required.

The invention is preferably applied to grilling appliances or grilling devices but can be used wherever good browning with short cooking times and/or a safety function (by coupling with the door opening) is important.

The invention claimed is:

1. A method for controlling a cooking process in a closed cooking compartment of a cooking appliance, comprising:

a heating device for heating the cooking compartment, said heating device being operable to apply radiant heat to an item in said cooking compartment;

the temperature in said cooking compartment is set to a desired heating temperature (TG) for the food in a cooking process;

said heating device is switched on and off in a temperature regulating cycle once a pre-determined switching temperature has been reached in said cooking compartment during said cooking process to thereby ensure that the temperature in said cooking compartment is between an upper limit cooking temperature and a lower limit cooking temperature;

the temperature during said cooking process is then reduced from a predetermined temperature below the upper cooking limit temperature over the course of a temporary cooling-down phase (tA) in said cooking compartment such that the temperature in said cooking compartment eventually decreases below the lower limit cooking temperature; and the temperature during said cooking process then is increased again during a subsequent heating-up phase (tVS) in said cooking compartment to raise the temperature in said cooking compartment from a temperature below the lower limit cooking temperature to a temperature between the upper limit cooking temperature and the lower limit cooking temperature.

2. The method according to claim 1, including said temporary cooling-down phase (tA) is brought about by an unscheduled switch-off of said heating device relative to said regulating cycle.

3. The method according to claim 2, including said heating device is switched off when opening said cooking compartment.

4. The method according to claim 1, including said temporary cooling-down phase (tA) is introduced shortly before reaching said cooking temperature (TG).

5. The method according to claim 1, including said temporary cooling-down phase (tA) is introduced when said food is turned.

6. The method according to claim 5, including said heating device is switched off when opening said cooking compartment to turn said food introducing said temporary cooling-down phase (tA).

7. A cooking device, comprising:

a cooking compartment in which an item can be placed to be heated;

a heating device for heating an item that has been placed in said cooking compartment, said heating device being operable to apply radiant heat to the item;

a door for accessing said cooking compartment, said door being movable between an open position in which access can be had to said cooking compartment and a closed position in which access to said cooking compartment is prevented;

a temperature sensor for sensing the temperature in said cooking compartment; and a control assembly operatively connected to said temperature sensor and operable to cyclically turn on said heating device and turn off said heating device to thereby ensure that the temperature in said cooking compartment is between an upper limit cooking temperature and a lower limit cooking temperature, said control assembly being operable, when the temperature in said cooking compartment eventually decreases along a path of increasingly lower temperatures as a result of said heating device being in a turned off condition, to turn on again said heating device during such a decrease of the temperature in said cooking compartment along a path of increasing lower temperatures before the temperature in said cooking compartment decreases below the lower limit cooking temperature, said control assembly controlling the turning on and the turning off of said heating device in a cyclic manner to thereby ensure that the temperature in said cooking compartment is between the upper limit cooking temperature and the lower limit cooking temperature, and said control assembly being operable to turn off said heating element upon the occurrence of a predetermined temperature below the upper cooking limit temperature, said control assembly being operable, during a temporary cooling-down phase (tA), to maintain said heating element in a turned off status following an occurrence of a predetermined temperature below the upper cooking limit temperature such that the temperature in said cooking compartment eventually decreases below the lower limit cooking temperature, and said control assembly being operable to substantially continuously maintain said heating element in its turned on condition during a subsequent heating-up phase (tVS) following a temporary cooling-down phase (tA) to raise the temperature in said cooking compartment from a temperature below the lower limit cooking temperature to a temperature between the upper limit cooking temperature and the lower limit cooking temperature.

8. The cooking device according to claim 7, including a switching contact engageable and activated by said door in at least one of an open or a closed position, said switching contact being operatively connected to said control assembly and said control assembly being operable, when said heating element has already been in a turned on condition during a cooking process and said switching contact has indicated that said door has been opened, to maintain said heating element in a turned off status in a predetermined heating element turn-off event such that during a temporary cooling-down phase (tA) ensures and the temperature in said cooking compartment eventually decreases below the lower limit cooking temperature.

9. The device according to claim 7, including a switching contact engageable and activated by said door in at least one of an open or a closed position, said switching contact being operatively connected to said control assembly and said control assembly being operable, in response to a signal from said switching contact that said door has been closed after said heating element has already been in a turned on condition during a cooking process and said switching contact has already indicated that said door has been opened and a temporary cooling-down phase (tA) has elapsed, to substantially continuously maintain said heating element in its turned on condition during a heating-up phase (tVS) to raise the temperature in said cooking compartment from a temperature below the lower limit cooking temperature to a temperature between the upper limit cooking temperature and the lower limit cooking temperature.

* * * * *